US009481068B2

(12) United States Patent
Toycen et al.

(10) Patent No.: US 9,481,068 B2
(45) **Date of Patent: *Nov. 1, 2016**

(54) LOW SPEED HIGH FEED GRINDER

(71) Applicants: Jeff Toycen, Ottawa (CA); Marty W. Rogers, Jasper (CA)

(72) Inventors: Jeff Toycen, Ottawa (CA); Marty W. Rogers, Jasper (CA)

( * ) Notice: Subject to any disclaimer, the term of this patent is extended or adjusted under 35 U.S.C. 154(b) by 0 days.

This patent is subject to a terminal disclaimer.

(21) Appl. No.: 14/810,112

(22) Filed: Jul. 27, 2015

(65) Prior Publication Data

US 2016/0001415 A1 Jan. 7, 2016

Related U.S. Application Data

(63) Continuation of application No. 13/766,742, filed on Feb. 13, 2013, now Pat. No. 9,089,946.

(60) Provisional application No. 61/672,523, filed on Jul. 17, 2012, provisional application No. 61/598,412, filed on Feb. 14, 2012.

(51) Int. Cl.
*B24B 27/02* (2006.01)
*B24D 3/06* (2006.01)

(52) U.S. Cl.
CPC ..... *B24B 27/02* (2013.01); *B24D 3/06* (2013.01)

(58) Field of Classification Search
CPC ... B24B 23/0005; B24B 23/02; B24B 27/02; B24D 3/06; B24D 15/023; B24D 15/04; B24D 11/00; B24D 15/00
USPC ..... 451/259
See application file for complete search history.

(56) References Cited

U.S. PATENT DOCUMENTS

| | | | |
|---|---|---|---|
| 1,059,877 | A | 4/1913 | Keighley |
| 1,072,620 | A | 9/1913 | Klay |
| 1,089,247 | A | 3/1914 | Smith |
| 2,153,502 | A | 4/1939 | Ocenasek |
| 2,408,148 | A | 9/1946 | Longbotham |

(Continued)

FOREIGN PATENT DOCUMENTS

| | | |
|---|---|---|
| JP | 2010201539 | 9/2010 |
| WO | 2007113510 | 10/2007 |

OTHER PUBLICATIONS

U.S. Appl. No. 13/766,742, Non-final Office Action, dated Aug. 21, 2014, 26 pages.

(Continued)

*Primary Examiner* — George Nguyen
(74) *Attorney, Agent, or Firm* — Letters Patent, LLC; Dennis R. Haszko

(57) ABSTRACT

A tool grinder is disclosed which includes a variable speed DC motor having an output shaft, and a cutter wheel mounted on the output shaft and having a precision coating of prone superabrasive particles. The grinder preferably further includes a motor controller for governing a rotational speed of the motor between 100 rpm and 2000 rpm. This minimizes the surface speed of the cutter wheel and the friction heat generated by contact of the workpiece with the cutter wheel. The precision coating of prone superabrasive particles minimizes rubbing contact between the cutter wheel and the workpiece during material removal from the workpiece. The cutter wheel preferably has a first cutting surface parallel to an axis of rotation of the wheel and one or more additional cutting surfaces perpendicular to the axis of rotation, at another angle to the axis of rotation, or both.

4 Claims, 6 Drawing Sheets

(56) References Cited

U.S. PATENT DOCUMENTS

| | | | | |
|---|---|---|---|---|
| 2,569,313 | A | 9/1951 | Horn | |
| 2,594,959 | A | 4/1952 | Masters | |
| 2,755,601 | A | 7/1956 | Lux | |
| 2,811,960 | A | 11/1957 | Fessel | |
| 3,054,231 | A | 9/1962 | Romanek | |
| 3,162,187 | A | 12/1964 | Christensen | |
| 3,338,230 | A | 8/1967 | Lindblad | |
| 3,650,936 | A | 3/1972 | Towle | |
| 3,763,844 | A | 10/1973 | Stevens | |
| 3,768,350 | A | 10/1973 | Coulter | |
| 3,811,228 | A | 5/1974 | Nagashima et al. | |
| 3,878,761 | A | 4/1975 | Makowski | |
| 4,369,605 | A | 1/1983 | Opersteny et al. | |
| 4,489,524 | A | 12/1984 | Watson | |
| 4,501,091 | A | 2/1985 | Ignatuk et al. | |
| 4,542,551 | A | 9/1985 | Phillips | |
| 4,662,117 | A | 5/1987 | Korwin et al. | |
| 4,685,845 | A | 8/1987 | Emter | |
| 4,712,332 | A | 12/1987 | Smith | |
| 4,805,353 | A | 2/1989 | Keith et al. | |
| 4,915,709 | A | 4/1990 | Andrew et al. | |
| 5,012,617 | A | 5/1991 | Winstanley | |
| 5,035,087 | A | 7/1991 | Nishiguchi et al. | |
| 5,056,265 | A | 10/1991 | Hurst | |
| 5,090,159 | A | 2/1992 | Patterson | |
| 5,218,787 | A | 6/1993 | Rice | |
| 5,253,384 | A | 10/1993 | Joines et al. | |
| 5,289,605 | A | 3/1994 | Armbruster | |
| 5,489,235 | A | 2/1996 | Gagliardi et al. | |
| 5,518,443 | A | 5/1996 | Fisher | |
| 5,525,095 | A | 6/1996 | Baughman | |
| 5,537,987 | A | 7/1996 | Okawauchi | |
| 5,620,489 | A | 4/1997 | Tselesin | |
| 5,637,034 | A * | 6/1997 | Everts | B24B 23/04 451/162 |
| 5,656,045 | A | 8/1997 | Wiand | |
| 5,759,093 | A * | 6/1998 | Rodriguez | A45D 29/05 132/73.6 |
| 5,816,893 | A * | 10/1998 | Kangasniemi | B24B 3/605 451/158 |
| 5,871,005 | A | 2/1999 | Sueta | |
| 5,967,882 | A | 10/1999 | Duescher | |
| 5,993,297 | A | 11/1999 | Hyatt et al. | |
| 6,110,031 | A | 8/2000 | Preston et al. | |
| 6,123,611 | A | 9/2000 | Lawrence, Jr. | |
| 6,478,831 | B2 | 11/2002 | Tselesin | |
| 6,547,648 | B1 | 4/2003 | Zhu et al. | |
| 6,638,152 | B1 | 10/2003 | Kim et al. | |
| 6,722,968 | B2 | 4/2004 | Rizzo et al. | |
| 6,872,133 | B2 | 3/2005 | Lee et al. | |
| 7,500,486 | B2 | 3/2009 | Gilg | |
| 7,972,200 | B2 | 7/2011 | Stanfield | |
| 8,347,872 | B2 | 1/2013 | Gobright, IV | |
| 8,439,727 | B1 | 5/2013 | Woodard | |
| 8,677,985 | B2 | 3/2014 | Gobright, IV | |
| 9,089,946 | B1 * | 7/2015 | Toycen | B24D 3/06 |
| 2001/0000503 | A1 | 4/2001 | Beaudry et al. | |
| 2001/0041525 | A1 | 11/2001 | McCracken et al. | |
| 2002/0177388 | A1 | 11/2002 | Hinch | |
| 2003/0045213 | A1 | 3/2003 | Keipert et al. | |
| 2005/0032469 | A1 | 2/2005 | Duescher | |
| 2005/0253005 | A1 | 11/2005 | Watanabe | |
| 2007/0218819 | A1 | 9/2007 | Schwaiger et al. | |
| 2008/0261496 | A1 | 10/2008 | Mase et al. | |
| 2008/0274675 | A1 | 11/2008 | Chen | |
| 2009/0165768 | A1 | 7/2009 | Kasashima et al. | |
| 2010/0240286 | A1 | 9/2010 | Deshpande et al. | |
| 2010/0275522 | A1 | 11/2010 | Kasashima et al. | |
| 2010/0304647 | A1 * | 12/2010 | Boisjoli | B60S 3/042 451/340 |

OTHER PUBLICATIONS

U.S. Appl. No. 13/766,742, Non-final Office Action, dated Nov. 26, 2014, 32 pages.

U.S. Appl. No. 13/766,742, Notice of Allowance, dated Jun. 22, 2015, 24 pages.

DC Motors Advantages and disadvantages over AC motors?, May 7, 2011—Dharma Teja.

* cited by examiner

LOW SPEED HIGH FEED GRINDER

CROSS REFERENCE TO RELATED APPLICATIONS

This is a Continuation of U.S. Ser. No. 13/766,742 filed Feb. 13, 2013, which claims priority from U.S. Provisional Application Ser. No. 61/598,412, filed Feb. 14, 2012 and entitled TRADESMAN, MACHINISTS HI TORQUE, DC, VARIABLE SPEED SUPER ABRASIVE BENCH MOUNTED GRINDER and U.S. Provisional Application Ser. No. 61/672,523, filed Jul. 17, 2012 and entitled LOW SPEED HIGH FEED GRINDER, the contents of which are incorporated into the present application in their entirety.

FIELD OF THE INVENTION

The invention relates to grinders, in particular to grinders with variable speed motors.

BACKGROUND ART

Bench grinders or table top tool grinders are used in practically every manufacturing or fabrication environment and sheet metal, casting, lock smithing, maintenance and tool manufacturing shops, and even in wood turning shops.

Traditional bench grinders use dual shaft AC motors and hot press composite bonded wheels.

Traditional tool cutters or grinders generally include a table top or base to which a grinding assembly with a motor and a composite bonded grinding wheel is mounted and either a single, adjustable cutting station, or multiple cutting stations for supporting the tool or cutter to be sharpened or ground at different angles relative to the grinding wheel.

Setups with composite grinding wheels require substantial mechanical effort to abrade or cut away material. Moreover, the particles on the composite wheels must erode for the wheel to stay sharp.

In composite material wheels, a significant portion of the material in the wheel is not of an abrasive nature, but is binder material. Consequently, much of the contact between the wheel and the article to be ground and pushed against the wheel is rubbing contact rather than cutting contact. In fact, 50% or more of the total contact area between the wheel and the article to be ground is in rubbing contact. This requires the wheels to be rotated at a certain threshold speed and the article to be forced against the wheel at a certain threshold force, before any usable rate of material removal can be achieved.

The actual speed of the edge of the stone wheel in a standard grinder wheel of 6 inch diameter is 61 mph (6 inch diameter=18 inch circumference or 1.5 feet×3600 rpm=5400 feet per minute=61 mph). However, the combination of elevated speed and contact force, together with the majority of the contact being rubbing type contact, creates several major disadvantages, the need for large, noisy motors, the generation of excessive heat, a slow material removal rate, wearing down of the grinding wheels, the creation of large amounts of dust (wheel wear) and the generation of smoke and unpleasant odors, due to (over) heating of the binder material in the wheel.

Composite "stone"/mineral composition wheels like aluminum oxide, carborundum, or silica type become instantly dull on the surface without constant attention or "dressing", causing excess friction at these high speeds. Composite mineral wheels also are constantly changing shape, requiring the tool rests to be adjusted so as to maintain safe settings as they deteriorate, while emitting dust which is harmful to the operator. Also, the article being ground requires constant cooling down due to the frictional heat generated. The person skilled in the art of tool sharpening will appreciate that excessive heat is the most challenging problem with conventional grinder technology, since many tool materials are damaged by heat. This often requires the use of a coolant, adding another layer of complexity and impracticality.

The use of AC motors creates a further disadvantage, the need for a higher starting speed. It is a characteristic of AC motors that their rotation speed under load is significantly lower that at no load. This means that in order to operate at a desired speed under load, the motor speed without load must be adjusted significantly higher. However, due to the rubbing friction disadvantage of conventional grinder wheels, a high initial surface speed causes and even faster heating up of the article being ground and, thus, significantly increases the danger of overheating the article already at the beginning of the grinding operation. Moreover, although bench grinders and tool grinders with speed controlled AC motors are known, all AC motor speed controls, usually operating on the basis of phase clipping, result in progressively lower motor torque at decreasing speeds, making grinding at lower speeds extremely time consuming. Moreover, grinding speeds below 50% of the synchronous speed of the motor are impossible to achieve with AC motors, which means grinding below 1800 rpm will not be achievable with AC motor grinders.

Different types of composite or stone wheels are known. However, all wheels are subject to wear, especially uneven wear, which means the wheels have to be periodically dressed, causing unnecessary waste and even faster wearing down of the wheel. Thus, a need for an improved grinder exists.

SUMMARY OF THE INVENTION

It is now an object of the invention to overcome at least one of the disadvantages of prior art bench grinders and tool grinders.

This object is achieved in an exemplary embodiment of the invention by the combination of a speed controlled DC motor and a diamond or cubic boron nitrate (CBN) plated/encrusted cutter wheel.

The DC motor is preferably controlled to rotate at speeds of 100-3500 rpm, most preferably 100 to 2000 rpm.

Mineral based grinding wheels are much softer than diamond or Cubic boron nitride plated cutter wheels. The latter abrasives are both classified as superabrasives.

Wheels or disks coated with superabrasives are known, but have never been used on a bench grinder. Variable speed AC motors have been used on conventional bench grinders, but not DC motors and certainly not any motors rotating at speeds below 2000 rpm, since most AC motors loose the majority of their torque even above that speed.

DC motors have the ability to develop a more constant torque as a result of more efficient application of magnetic principles due to the use of a permanent magnet, while with AC motors the strength of the magnetic field produced by an AC electro-magnetic coil increases and decreases with the increase and decrease of the alternating current flow, which is in contrast to the constant magnetic field and current direction of the brushed DC system.

DETAILED DESCRIPTION OF THE INVENTION

Figure 8:
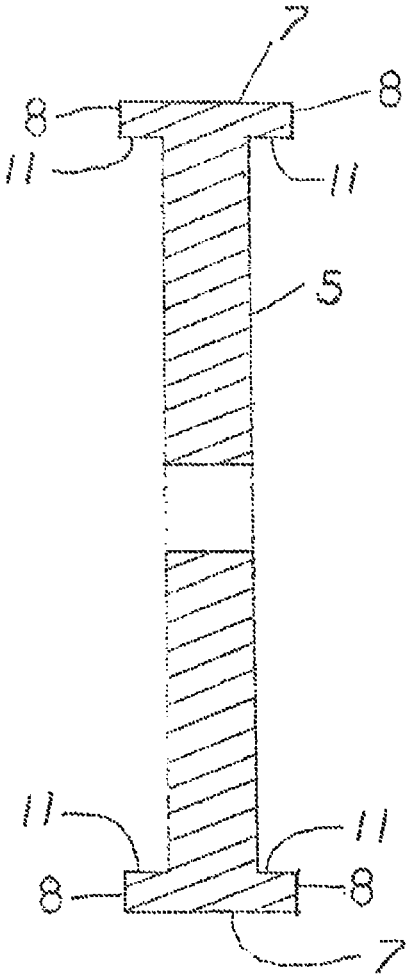
FIG. 8: is an axial cross-sectional view of a cutter wheel.
Figure 9:
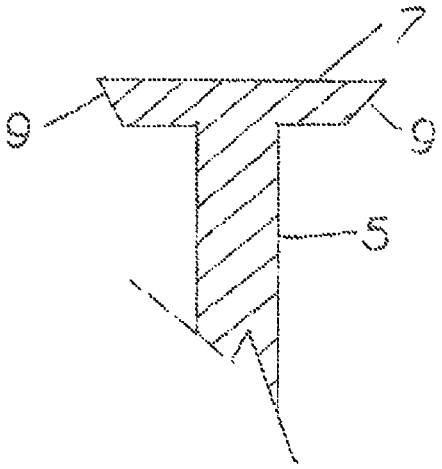
FIG. 9: is a partial cross-sectional view through another cutter wheel.

In an exemplary embodiment, as illustrated in FIGS. 1-4, the tool grinder of the present invention includes a variable speed DC motor 2 having an output shaft 6 and a cutter wheel 5 mounted on the output shaft and having a precision coating of a superabrasive material. The speed of DC motor 2 is preferably controlled by a high voltage DC motor controller 3. In the preferred embodiment as illustrated, the DC motor 2 includes two output shafts 6, respectively at opposite ends of the motor and a cutter wheel 5 mounted to each shaft. The motor controller preferably governs the rotational speed of the DC motor 2 between 400 rpm and 3500 rpm, preferably between 400 rpm and 2000 rpm. The cutter wheels preferably have different diameters and/or different grit. Preferably, the cutter wheels 5 have a first cutting surface 7 parallel to an axis of rotation of the wheel and a second cutting surface 8 perpendicular to the axis of rotation, both cutting surfaces being coated with the superabrasive material (see FIG. 8). In another embodiment, at least one of the cutter wheels has a first cutting surface 7 parallel to an axis of rotation of the wheel, a second cutting surface 9 at an angle to the axis of rotation, both cutting surfaces being coated with the superabrasive material (see FIG. 9). In still a further embodiment, at least one of the wheels 5 has a first cutting surface 7 parallel to an axis of rotation of the wheel and located at an outer circumference of the wheel, a second cutting surface 8 perpendicular to the axis of rotation and located on an axial face of the wheel and a third cutting surface 11 parallel to the axis of rotation and directed towards the axis of rotation, the third cutting surface being provided by an undercut in an axial face of the wheel, all cutting surfaces being coated with the superabrasive material (see FIG. 8).

In a bench grinder arrangement 100 of the tool grinder of the invention as illustrated in FIGS. 1-4, the arrangement includes a base plate 1, with sub plate for mounting accessories to sharpen different tools; a twin shaft small diameter DC motor 2 (model; manufacturer); a high voltage DC motor controller 3 (Toycen Industries); precision large bore wheel mount hubs 10 and safety caps 4; and precision plated diamond and/or cubic boron nitride armored grit profiled steel cutter wheels 5.

Figure 1:
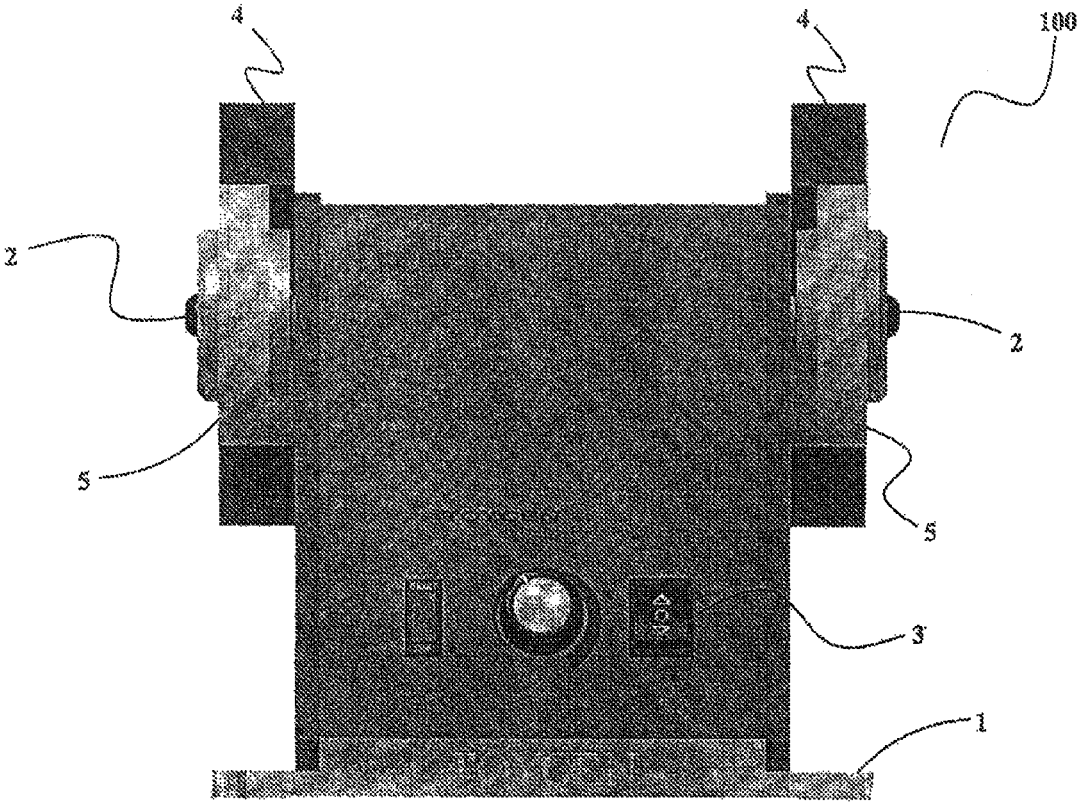
FIG. 1: is a front perspective view of an exemplary grinder arrangement in accordance with the invention, executed in the form of a bench grinder embodiment.
Figure 2:
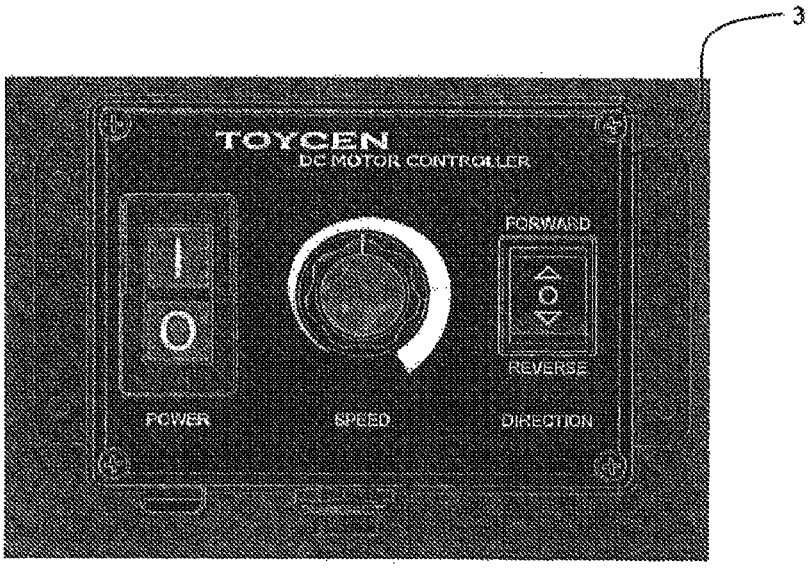
FIG. 2: is a perspective view of a DC motor controller in accordance with the invention.
Figure 3:
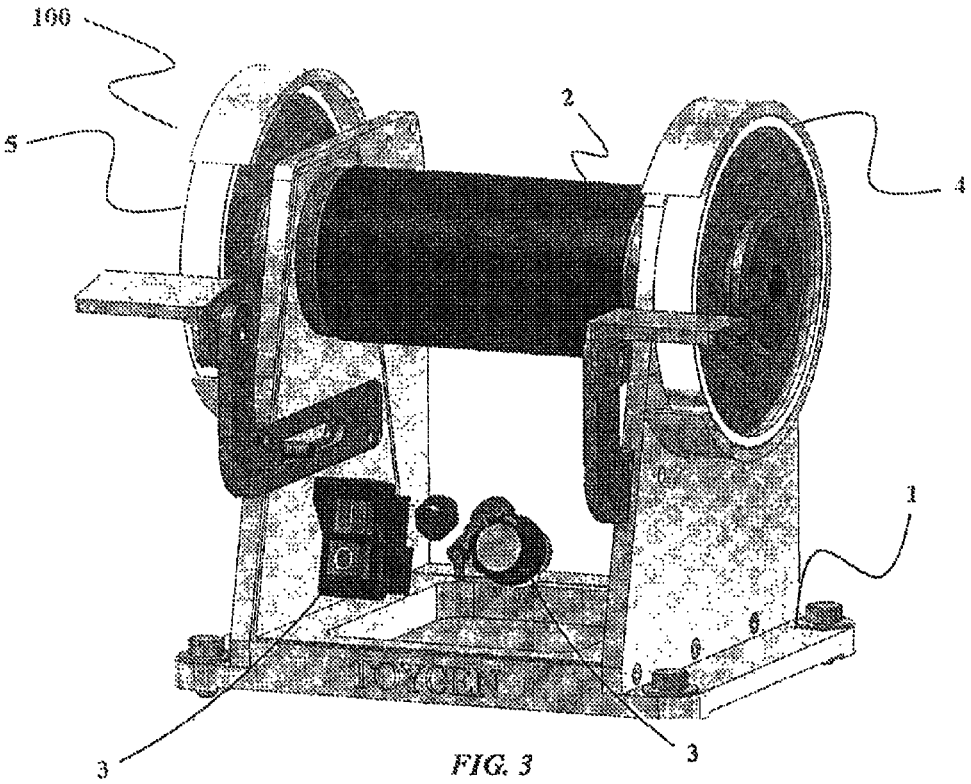
FIG. 3: is a cross sectional view of the arrangement of FIG. 1.
Figure 4:
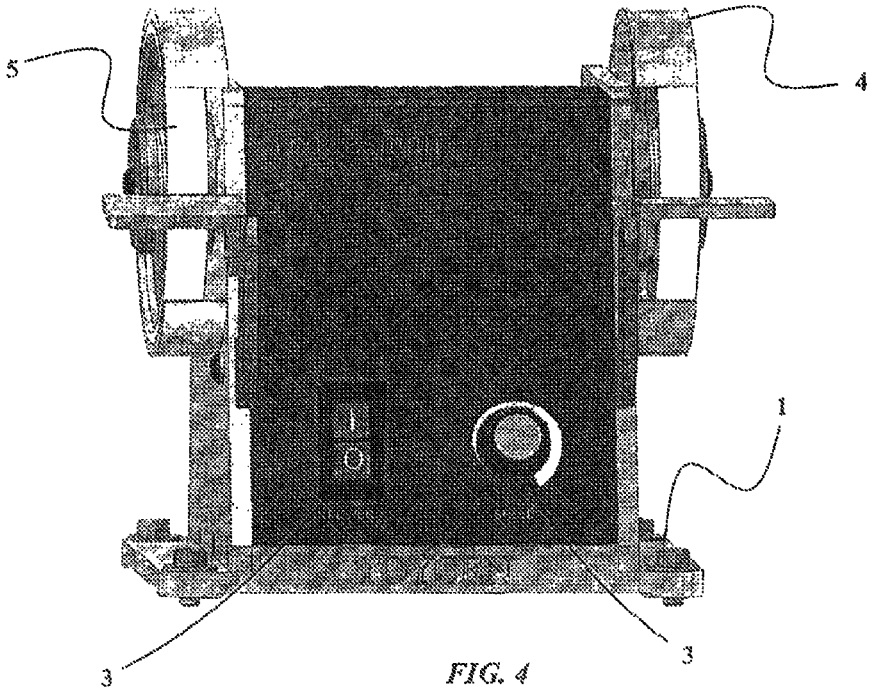
FIG. 4: is a detailed perspective view of the arrangement of FIG. 1.
Figure 5:
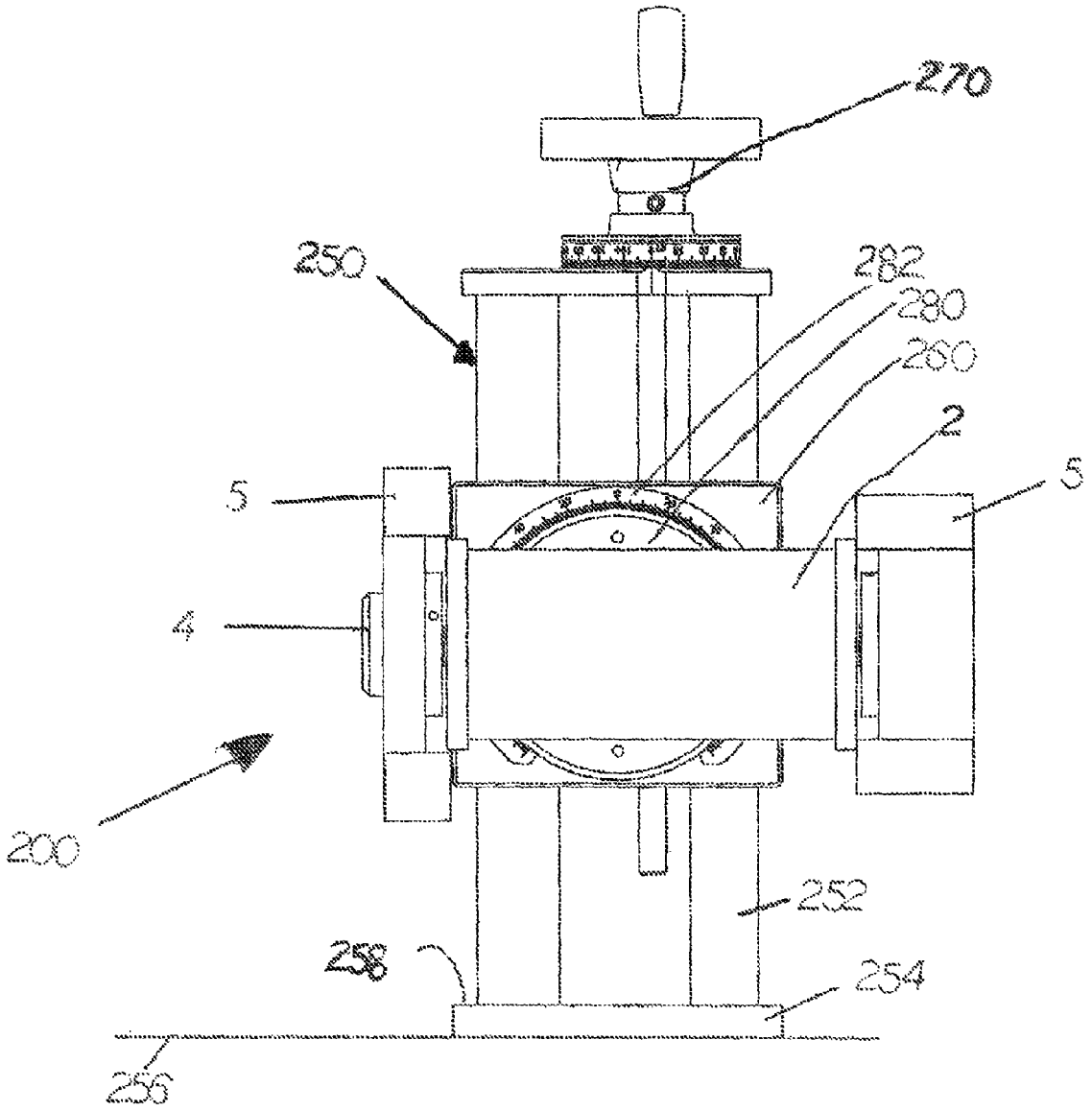
FIG. 5: is a front elevational view of another exemplary grinder arrangement in accordance with the invention, executed in the form of a table top tool grinder embodiment.
Figure 6:
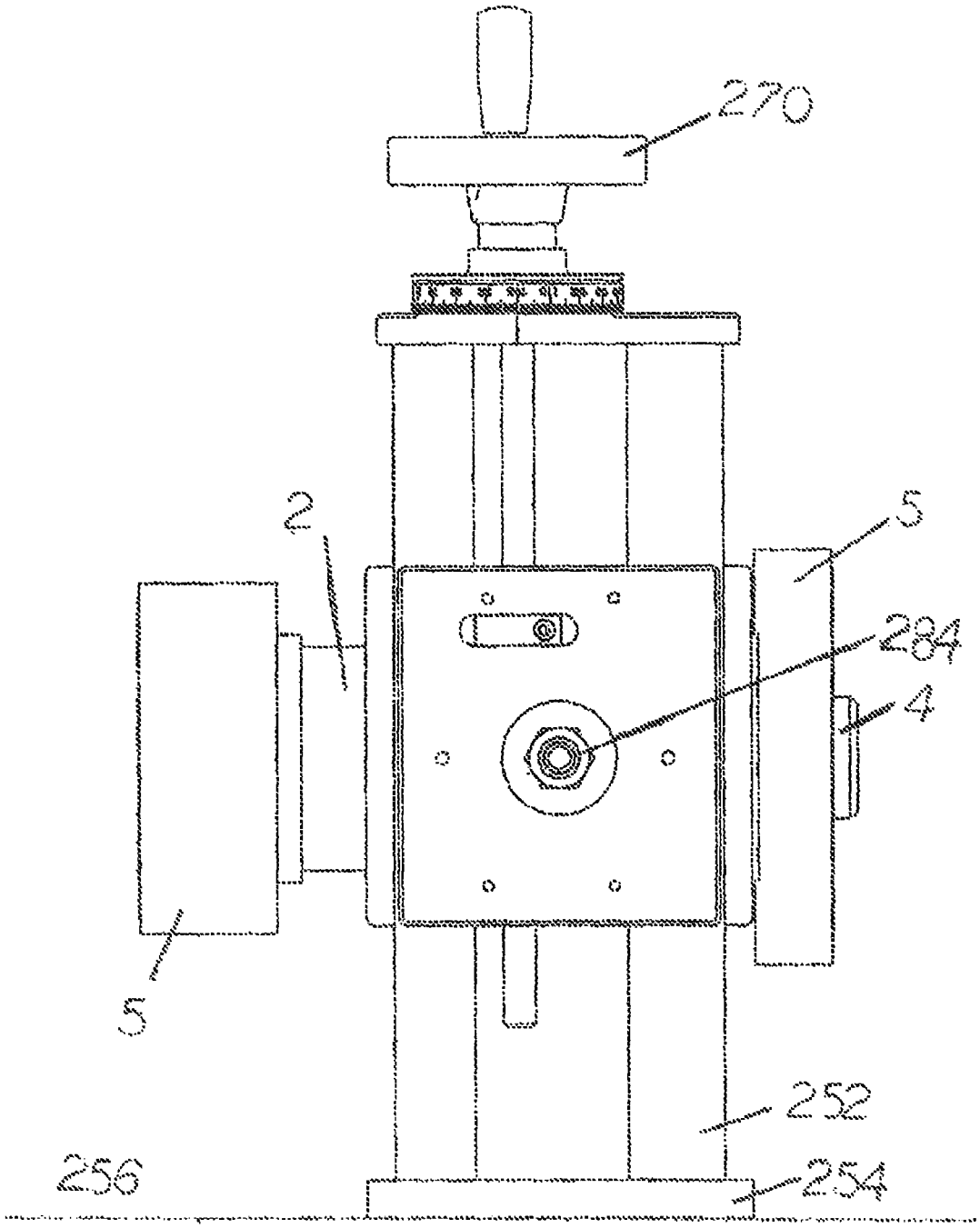
FIG. 6: is a rear plan view of the embodiment of FIG. 5.
Figure 7:
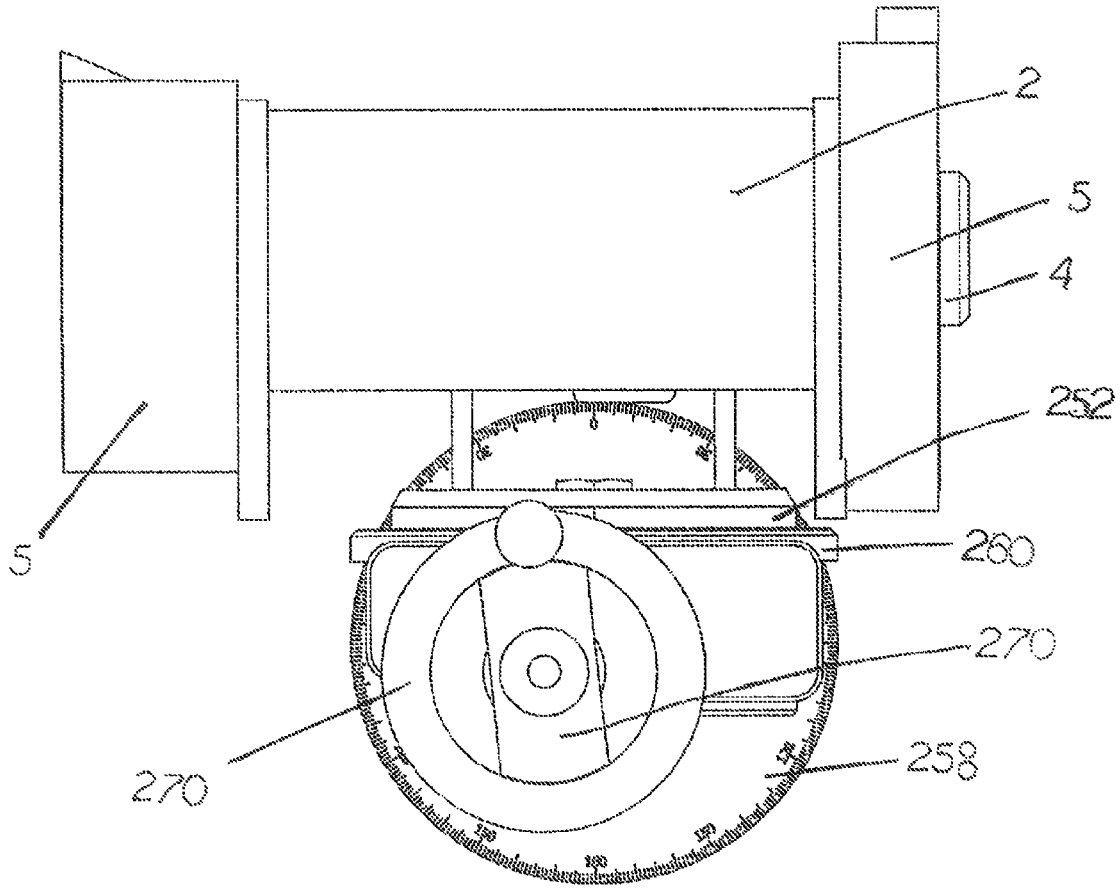
FIG. 7: is a top plan view of the embodiment of FIG. 5.

In a precision tool grinding arrangement 200 of the tool grinder of the invention as illustrated in FIGS. 5-7, a dual shaft DC motor 2, the high voltage DC motor controller 3, the precision large bore wheel mount hubs 10 and safety caps 4 and the precision plated diamond and/or cubic boron nitride armored grit profiled steel wheels 5, are mounted on a tower mount 250 which allows precision adjustment of the location of the wheels 5 in vertical direction and about a horizontal as well as a vertical axis. The tower includes a frame 252 with a base plate 254 that is rotatably attached to a base 256 (for example the table top of a conventional tool cutter arrangement) for rotation about a vertical axis. An angle guide 258 is provided on the base plate to allow for reproducible and exact angle adjustment. A releasable locking bolt (not shown) is provided for selective locking of the base plate 254 and frame 253 in a desired rotational position relative to the base 256. A sled 260 is slidably mounted on the frame 252 for movement in a direction perpendicular to the base 256 and parallel to the vertical axis of rotation of the frame 252. Preferably the sled 260 and frame 252 are interconnected by an indexing mechanism 270 which permits fine adjustment of the vertical position of the sled on the frame. Various different manual and automatic indexing mechanisms are known and will not be discussed here in detail. The motor 2 is mounted to the sled 260 by way of a motor base 280 which is rotatably affixed to the sled for rotation about an axis of adjustment which is perpendicular to the vertical axis of rotation of the frame 252. A second angle guide 282 is provided on the motor base to allow for reproducible and exact angle adjustment. A releasable locking bolt 284 is provided for selective locking of the motor base 280 on sled 260 in a desired rotational position relative to the vertical axis of rotation of the frame 252. This setup allows for a much more accurate and practical adjustment of the orientation and position of the cutter wheels 5 relative to a tool mounted on the base 256, than the conventional combination of multiple tool mounts or multiple adjustment mechanisms in the tool mount as well as the motor mount. Of course, the principle advantages achieved with the bench grinder embodiment of the tool grinder of the invention are also achieved with the tool grinding arrangement.

The term cutter wheels as used in the present specification is intended to distinguish from the terms stone wheels, composite wheels or grinding wheels, commonly used in the art. The term cutter wheel is used herein to define wheels made of permanent material, which have a precision coating of prone superabrasive material. The most important distinctions of cutter wheels over conventional grinder wheels are a virtual absence of rubbing contact between the wheel and an article to be ground, no wearing down of the wheel and the prone positioning of the abrasive materials, rather than the embedding in a carrier material. By avoiding wear of the wheel, the wheel diameter remains virtually the same over the whole service life of the wheel, making it possible to perform precision cuts and sharpening of tools. In other words, in the grinding or cutting of an article with the tool grinder of the present invention, wear occurs only on the article, not on the wheel. This is of course not possible with conventional grinder wheels made of abrasive materials embedded in a wearable matrix.

To retain their prone positioning on the surface of the cutter wheel, the superabrasive materials are bonded to the surface of the wheel. Suitable bonding methods for encasing superabrasives are known in the art and are not the subject of this application. These methods allow for the manufacture of cutter wheels made from a permanent material such as aluminum or steel, with the superabrasives bonded to the exterior surface of the wheel, for example by encasing them in nickel plating on the wheel. This protects the abrasive material and prevents damage, for example fracturing of the grain. By bonding the superabrasive materials to the surface of the cutter wheels, each abrasive particle projects from the surface of the wheel, rather than being embedded in the matrix of the wheel as in conventional grinder wheels.

Moreover, by encasing the superabrasive particles in a metal plating on the wheel, the particles remain prone on the surface of the wheel, much the same manner as a tooth on a milling cutter. Moreover, due to the elevated hardness, each superabrasive particle preserves its shape for a useful period of time, obviating the need for dressing of the wheel and avoiding wear of the wheel during grinding of an article. Consequently, rather than being able to simply surface grind an article to be sharpened, the use of cutter wheels allows a precision cutting of the article.

Due to the abrasive particles remaining prone on the cutter wheel in the arrangement in accordance with the invention, the contact of the article to be ground is virtually exclusively with the superabrasive and not to any significant degree with the material bonding the superabrasive, which means there is virtually no rubbing contact or wear of the wheel. It is for this reason that diamond or CBN coated wheels are considered cutter wheels rather than grinding wheels. Of course, the resulting advantages are longer service life of the wheel, virtually no heat generation, no smoke and very little wear debris, other than the material removed from the article, and a higher material removal rate.

The material removal rate with cutter wheels is much higher so that a significantly higher removal rate than with conventional bench grinders can be achieved at a fraction of the rotational speed of the wheels. In fact, a higher material removal rate can be achieved at circumferential speeds of the cutter wheel as low as 20 mph. This even further reduces noise, dust and heat generation. More importantly, since the cutter wheels carry the superabrasive material only along their circumference and can be rotated at much lower speeds, injury upon contact with the wheel is much reduced and a much more delicate control of the sharpening or grinding of the article is made possible.

In addition, compared to conventional grinders, much smaller articles which virtually no heat sink capacity can be sharpened/ground with the arrangement in accordance with the invention without heat damage, due to the much reduced friction heat generated. For example, with a conventional stone wheel grinder, a 1/16" diameter drill would overheat/burn instantly, while it can be sharpened with the arrangement of the invention without significant heat development and much faster.

In a laboratory test, high speed steel shafts with a diameter of 0.750 inches were used for grinding/cutting testing and subjected to grinding at a wheel speed of 1000 rpm for 1 minute at an average contact pressure of about 3 lbs and a wheel grit of 200. After grinding with a dressed diamond resin wheel, the shaft diameter was reduced to 0.736 inches and the temperature of the work piece was 380 F. After grinding with a diamond plated cutter wheel, the shaft diameter was reduced to 0.695 inches and the temperature of the work piece was 300 F. Thus, the material removal rate with the cutter wheel was about 4 times higher, while the final temperature of the work piece was significantly lower. The difference in temperature was tempered by the large size of the work piece and the resulting heat sink. Larger temperature differentials are observed when running the same test at higher shaft speeds and/or with work pieces having a smaller volume, such as cutting tools or milling tools.

The benefit of reduced friction heat is much more evident when grinding cutting tools, as there is much less material that can act as a heat sink at the edge of the flute up towards the edge being sharpened. At the high surface speed common with resin wheels (much higher than 1000 rpm; commonly above 3000 rpm) the tool edge sustains thermal damage easily unless extremely light cuts are taken, commonly in the range of 0.001-0.002 inch. That results in very lengthy sharpening times, especially if carbide tools are to be sharpened, since a reliable sharpening of a carbide tool requires the removal of at least 0.002 inch of material. Sharpening a carbide tool with a conventional AC motor/grinder wheel combination requires many pass repeats in order to get to a finished product, while a finished product can be achieved with the DC Motor/Cutter wheel combination of the invention in as little as one pass.

Due to the much higher material removal capacity of cutter wheels at much lower shaft and wheel speeds, shorter tool sharpening times can be achieved at lower wheel speeds and, thus, reduced risk of heat damage to the tool being sharpened. However, higher material removal rates at lower shaft speeds require constant torque output of the motor, which is not achievable with AC motors. Thus, the combination of a cutter wheel with a DC motor provides additional, unexpected and synergistic benefits not achievable with a conventional grinding wheel on a DC motor or a cutter wheel on an AC motor.

In another laboratory test, high speed steel shafts with a diameter of 0.750 inches were used for grinding/cutting testing and subjected to grinding with an AC motor/AIO grinding wheel combination at a wheel speed of 3600 rpm for 1 minute at an average contact pressure of about 3 lbs and a wheel grit of 60. After 1 minute, the shaft diameter was reduced to 0.71 inches and the temperature of the work piece was 325 F. During grinding, the speed of the AC motor dropped to 2800 rpm. The same test was run on a DC motor/CBN coated cutter wheel at a speed of 3600 rpm and a wheel grit of 100. After 1 minute, the shaft diameter was reduced to 0.66 inches and the temperature of the work piece was 300 F. During grinding, the speed of the DC motor dropped to 3500 rpm. Thus, the material removal rate with the cutter wheel was about 2.25 times higher, while the final temperature of the work piece was about the same. These results are very significant and quite surprising, since a much finer grit wheel (such as the diamond wheel in this test) should theoretically result in less material removal. Moreover, the significantly higher operating speed (700 rpm higher) and finer grit together should result in much higher heat generation than with the slower, coarser grit wheel. In other words, one would theoretically expect the DC motor/CBN wheel combination to cause a lower material removal than the AC motor/AIO grinding wheel combination, at a higher final temperature of the work piece. In addition, the grinding wheel was subjected to wear, (0.06 inch diameter reduction), while the diameter and surface of the CBN wheel remained unchanged. Clearly, the DC motor/CBN wheel combination provides unexpected and synergistic advantages contrary to what would be theoretically predictable from the testing setup.

The application of a cutter wheel, as defined herein, with its unique characteristics along with the powerful low speed torque of the DC motor provides an opportunity for a grinding process whereby in High Speed steel, cobalt, or carbide cutting tools, material can be removed at high rates without the generation of excessive heat. This allows for significantly reduced tool sharpening times, while preventing substrate damage through thermal cycling. Fabricating composites or other thermally sensitive materials with heavy accurate material removal is thus made possible by the inventive combination of the suberabrasive plated cutter wheel driven at low RPM by a DC Motor.

The cutter wheel or wheels of the arrangement in accordance with the invention are preferably turned from solid steel on numerically controlled equipment to very exact tolerances for profile and mounting features, then balanced so as to run exceptionally true and free from vibration. CBN or Diamond Media is electroplated onto the surface of the wheel in prescribed areas in a very precise layer of nickel producing a very flat uniform surface with precise surface roughness.

Because the cutter wheel behaves like a milling cutter, and the speed of the DC motor is variable, while the torque is virtually constant, the arrangement of the invention can be used to grind any solid material, including aerospace alloys, carbon fibre, fiberglass and other composites. Moreover, the arrangement of the invention with the super abrasive plated wheels is capable of taking heavy cuts and leaving a superior finish without generating excessive heat through friction.

The arrangement of the invention allows the user to take both heavy low heat cuts as well as being able to get an accurate delicate cut on smaller tools. One because of surface feet, the other because the user can see the wheel due to a slower speed (combined with a reduction of risk to life and limb). When combined with reduced operation time, these new operational situations presented by the arrangement of the invention represent a substantial break from the norm of heat, smoke, dust and burned fingers and tools.

A DC motor develops about 500% more torque for its size, due to its superior design, than a comparable AC motor. The precision plated wheels are mounted on large precision wheel mounts and through their unique design provide an extremely rigid grinding action that is free of normal stone wheel dust. The newly designed drive can be stationary mounted with accessories or it can be machine mounted.

The grinder arrangement of the invention can be designed in several different configurations, namely standard bench grinder with 6 inch wheels, or with 6 and 8 inch combination wheels, as shown in FIGS. 1-4, a single wheel version (not shown) and a tool grinder embodiment for use with tool grinder setups, as illustrated in FIGS. 5-7, which can be used, for example on the conventional Cuttermaster™ device available from Toycen Industries, Ottawa, ON.

A digital speed controller is preferably used on the DC motor. The advantages of a digital controller over a simpler analog device are more precise speed and torque control under varying load conditions, user definable speed limits (lower/upper), fast, precise motor braking, configurable user interface with display options (alphanumeric/graphic) and speed/directional control with pre-settable safety delays. Preferred components of the digital controller design are an AC to DC converter and power supply, a high-voltage H-bridge motor controller, a microcontroller and control software. Multiple controller designs are commercially available (Toycen Industries, Inc.; Ottawa, ON).

The DC motor used in the preferred embodiment (Dumore Corporation; custom designed PMDC motor, model No. 3230NBM004-6) requires a high voltage, about 140V, at medium current of 3 to 5 amps. In addition, a lower voltage (5 volts nominal) at very low current (less than 1 amp) is required for logic control. This is to be constructed on small board real estate using low cost components. Digital board control is preferably used. With digital control, advanced safety techniques can easily be implemented in software and power to the motor can be ramped up when a change in load and RPM is detected using proprietary algorithms.

While the invention has been described with a certain degree of particularity, it is understood that the invention is not limited to the embodiments set forth herein for purposes of exemplification, but is to be limited only by the scope of the attached claims, including the full range of equivalency to which each element thereof is entitled. Although the present invention has been explained hereinabove by way of preferred embodiments thereof, it should be pointed out that any modifications to these preferred embodiments within the scope of the appended claims are not deemed to alter or change the nature and scope of the present invention.

What is claimed is:

1. A low speed, high feed tool grinder for controlling overheating of a workpiece, comprising a DC motor having an output shaft, a motor controller for governing a rotational speed of the DC motor and a cutter wheel mounted on the output shaft, wherein the motor controller governs the rotational speed between 100 rpm and 2000 rpm for minimizing a surface speed of the cutter wheel and friction heat generated by contact of the workpiece with the cutter wheel, and the cutter wheel has a precision coating of prone superabrasive particles for minimizing rubbing contact between the cutter wheel and the workpiece during material removal from the workpiece.

2. The tool grinder of claim 1, wherein the cutter wheel has a first cutting surface parallel to an axis of rotation of the wheel and a second cutting surface perpendicular to the axis of rotation, both cutting surfaces having the coating of prone superabrasive particles.

3. The tool grinder of claim 1, wherein the cutter wheel has a first cutting surface parallel to an axis of rotation of the wheel and a second cutting surface at an angle to the axis of rotation, both cutting surfaces having the coating of prone superabrasive particles.

4. The tool grinder of claim 1, wherein the cutter wheel has a first cutting surface parallel to an axis of rotation of the wheel and located at an outer circumference of the wheel, a second cutting surface perpendicular to the axis of rotation and located on an axial face of the wheel and a third cutting surface parallel to the axis of rotation and directed towards the axis of rotation, the third cutting surface being provided by an undercut in an axial face of the wheel, all cutting surfaces having the coating of prone superabrasive particles.

* * * * *